US006094834A

United States Patent [19]

Taipale et al.

[11] Patent Number: 6,094,834

[45] Date of Patent: Aug. 1, 2000

[54] ARRANGEMENT FOR DRYING SECTION OF PAPER MACHINE

[75] Inventors: Seppo Taipale, Siilinjärvi; Terttu Turpeinen, Juankoski, both of Finland

[73] Assignee: Tamfelt OYJ ABP, Tampere, Finland

[21] Appl. No.: 09/325,627

[22] Filed: Jun. 4, 1999

[30] Foreign Application Priority Data

Jun. 5, 1998 [FI] Finland ..... 981290

[51] Int. Cl.[7] ..... F26B 13/26; D06F 58/00

[52] U.S. Cl. ..... 34/71; 34/95; 34/116

[58] Field of Search ..... 34/71, 95, 116, 34/117, 124; 162/116, 124, 132, 206, 207; 156/210, 212, 219

[56] References Cited

U.S. PATENT DOCUMENTS

| | | | |
|---|---|---|---|
| 3,868,300 | 2/1975 | Wheeler | 162/124 |
| 4,112,586 | 9/1978 | Lehtinen | 34/71 |
| 5,098,522 | 3/1992 | Smurkoski et al. | 162/358 |
| 5,260,171 | 11/1993 | Smurkoski et al. | 162/117 X |
| 5,566,472 | 10/1996 | Lehtinen et al. | 34/242 |
| 5,604,995 | 2/1997 | Lehtinen | 34/417 |
| 5,778,555 | 7/1998 | Lehtinen et al. | 34/71 |
| 5,950,329 | 9/1999 | Lehtinen et al. | 34/392 |

FOREIGN PATENT DOCUMENTS 96790 8/1996 Finland .

*Primary Examiner*—Stephen Gravini
*Attorney, Agent, or Firm*—McDermott, Will & Emery

[57] ABSTRACT

The invention relates to an arrangement for a drying section of a paper machine, the arrangement comprising a fine wire (5*a*) and a coarse wire (5*b*) that are arranged to pass between metal bands (2, 3) of a band dryer (1) together with a web (4) to be dried. The fine wire (5*a*) comprises at least three interwoven textural layers, wherein the outermost layers, in other words a surface (10) and a bottom (11), have a finer texture than the middle section (12) situated between them. According to a preferred embodiment, the surface layer (10) is provided with a denser texture than the bottom (11), which, in turn, has a denser texture than the middle section (12).

6 Claims, 3 Drawing Sheets

ARRANGEMENT FOR DRYING SECTION OF PAPER MACHINE

Figure 1:
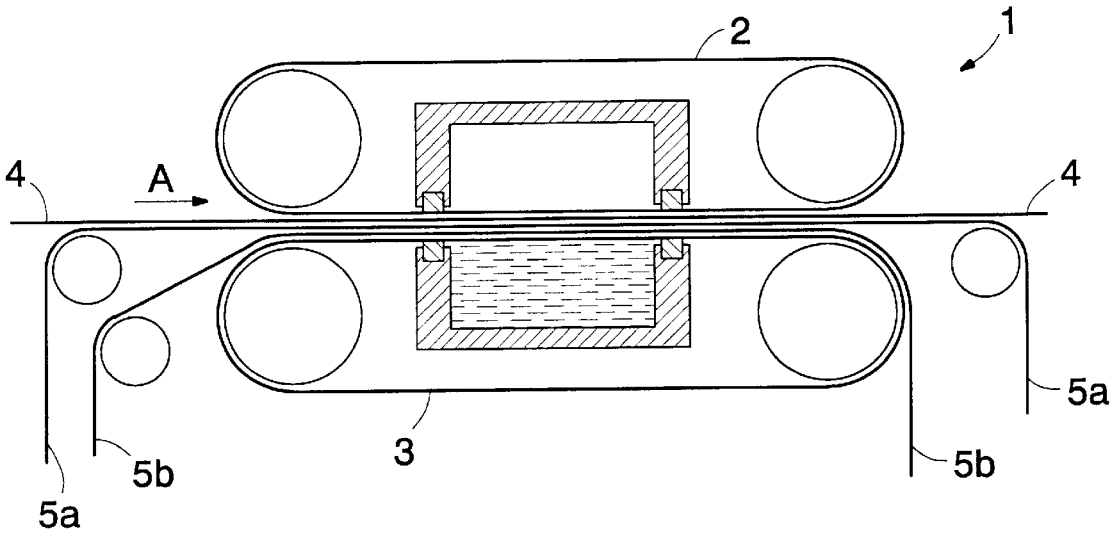

The invention relates to an arrangement for a drying section of a paper machine, the arrangement comprising a fine wire and a coarse wire which are formed of several threads and withstand high temperatures and humidity, the wires being arranged to pass through the drying section between a heated and a cooled metal band provided in the drying section, together with a fibre web placed against the heated band, such that the fine wire is arranged against the web to be dried and the coarse wire is arranged against the cooled metal band.

Paper machine fabrics, such as wires and felts, are used in different machines producing a web-like product from a pulp, such as paper machines, board machines or the like, which will be referred to herein as 'paper machines'. Paper machine fabrics are used at the wet end, the press section and the drying section of the paper machine for forming a web and guiding it via the different stages of the machine. At the beginning of the paper machine, a pulp is supplied to the wire for forming a web, and felts and wires are used in the press and drying sections of the machine. In the press section, water can be removed from the web when it is pressed for drying it before final drying by heat. When in use, paper machine fabrics rotate around different rolls and cylinders at a rate equal to that of the web.

A paper machine fabric is typically made of different threads of possibly varying cross-sections and materials in order to provide desired properties. Thread materials used include polyester, polyamide and other monofilament and multifilament threads. The manufacture of the fabrics employs different binding structures and combinations thereof, which should provide the fabric with desired properties suitable for the intended use. Dryer screens must operate under varying conditions, which means that sometimes they are subjected to heat and humidity and at other times to heat and drought. Further, a dryer screen is required to have good dimensional stability and durability as well as flexibility.

Typical paper machine fabrics include dryer screens used to guide the paper web to be dried through the drying section and to support the web so that the finished fibre web comprises as little marking as possible resulting from the texture of the wire, whereas the permeability and behaviour of the wire in the drying section is as desired. In dryer screens the object is to achieve as even and dense a surface structure as possible, in other words a high thread density, so that the web surface would be as smooth as possible. Usually the web is placed against the smoother surface of the dryer screen so that the occurrence of marking in the web can be prevented.

The drying of a fibre web may utilize a band dryer unit disclosed in Finnish Patent Application 944,775, wherein a fibre web is dried between two parallel metal bands moving in the same direction such that the web touches a heated metal band, and between the fibre web and the other, cooled metal band there is a wire so that as a result of heating the steam that evaporates from the fibre web is condensed in the wire due to the cold metal band. The wires may be bands made in the shape of a closed loop, or alternatively, bands that are connected together from their free ends to form a closed loop. A fibre web, a fine wire or fine felt and a coarse wire are carried between the upper band and the lower band through the drying section. The operation of the band dryer is based on the heating of the upper band that is in contact with the web, so that the water in the web evaporates due to the temperature of the upper band and it is transferred through the fine wire and the coarse wire towards the lower band. The lower band, in turn, is cooled so that steam produced on the surface of the band is condensed into water and it is discharged with the lower band and the coarse wire positioned against the lower band. The fine wire preferably comprises a plurality of permeable flow conduits. Free flow in the direction of the wire level can be equal in all directions, or stronger in one direction, or the flow may be prevented in any direction, if required. Further, the coarse texture should have a sufficient water retention capacity. The coarse texture of the coarse wire situated against the cooled metal band is not always able to retain the water that is condensed on the side of the cooled metal band, as desired, but some of the water may be able to disadvantageously move back towards the web. This so-called rewetting naturally reduces the efficiency of the dryer and causes problems in the following stages of the paper machine.

The purpose of the present invention is to provide an arrangement for a drying section in a paper machine, avoiding the drawbacks of the prior art and enabling more efficient drying of a web than previously.

The arrangement according to the invention is characterized in that the fine wire comprises at least three interwoven layers, wherein surface layers arranged against the web and the coarse wire are denser than a middle section situated between them.

The basic idea of the invention is that between the web to be dried and the cooled metal band of the band dryer the arrangement comprises a fine wire placed against the web and a coarse wire provided against the metal band. The fine wire is formed such that it comprises at least three interwoven textural layers. Further, the surface layers of the fine wire, in other words the side of the wire facing the paper and the side facing the coarse wire have a denser texture than the section situated between the layers. The basic idea of a preferred embodiment of the invention is that the surface layer of the fine wire facing the web is formed with the densest texture, the middle section of the wire has a looser texture, and the bottom of the wire facing the coarse wire is again formed with a dense texture, which is not as dense, however, as the surface layer of the wire facing the web. As regards the density of its structure, such a wire is asymmetrical with respect to the central axis of the wire. The basic idea of another preferred embodiment of the invention is that the textural structure of the fine wire is formed such that the threads in the machine direction or the warp threads are sheltered by the transverse weft threads almost along their entire length in the texture, wherefore the wearing effect and the pressure acting on the wire affect more the weft threads which are not significant for a wire break.

The invention has an advantage that due to its structure the fine wire can be made stiffer than previously, which means that it is suitable for use also in a situation where the coarse wire is arranged to travel between the bands so that the coarse side thereof faces the fine wire and the smoother side of the coarse wire faces the cooled metal band. In such a case, the stiffer fine wire according to the invention does not press into depressions and openings of the coarse wire resulting from its rough surface texture, but it is positioned suitably as an even surface, thus preventing the occurrence of marking in the web. The rougher surface texture of the coarse wire is therefore not able to produce marking on the web through the fine wire. The structure according to the invention with three or more layers where the outermost sections are made of a finer texture than the middle section form a sandwich structure which is advantageous in the production of stiff constructions. Due to such a structure, the fine wire may also be thin but still sufficiently stiff to prevent the occurrence of marking through the fine wire. A thin fine wire is advantageous especially in high-speed drying apparatuses, since a thin wire does not transport as much air between the bands as a thicker wire. Furthermore, a thin wire can be dried more easily after the washing than a thick wire before it is passed again between the bands of the drying apparatus. In the future development of the band dryer, the temperature of the hot band is raised continuously in order to improve the efficiency, which in turn sets higher and higher standards also for the wires to be used. Also, possible preheating of a fine wire must be taken into account when planning the behaviour of the wire during a run. A fine wire according to the invention also solves the aforementioned problems since due to its structure it is more stable and has better dimensional stability than previously, in other words it can be used better even at high temperatures without the occurrence of disadvantageous stretching, narrowing or other dimensional changes of the fine wire that would affect the quality of the drying. Another advantage is that the fine-textured bottom of the fine wire facing the coarse wire wears the coarse wire less and also wears itself down less than the fine wire used in the prior solutions where the bottom section facing the coarse texture is rough. The wearing caused by the movement of the fine wire and the coarse wire with respect to each other, for example the difference in speed between the wires, can thus be decreased by making the bottom of the fine wire smooth. The life of the wires can therefore be increased. However, the dense outermost layers of the fine wire do not prevent in any way the transfer of humidity through the fine wire, the humidity still being in the form of steam as it penetrates the fine wire. A further advantage is that the fine wire no longer soils easily due to its dense outer layers and the wire is therefore also easier to clean.

In this application, the terms 'fine texture' and 'dense texture' refer to a layer with lower water or air permeability, a greater number of threads per surface area, or a layer with a greater contact area achieved with flatter threads than in the other layers of the fabric. A dense fine texture may have all the aforementioned properties simultaneously. Such a dense layer can be provided on the surfaces of the fine wire in several different manners. It is possible to use either spun or doubled threads, threads with an oval or flat cross-section, or a lower thread density together with thicker threads, or a higher thread density and correspondingly thinner threads.

Figure 2:
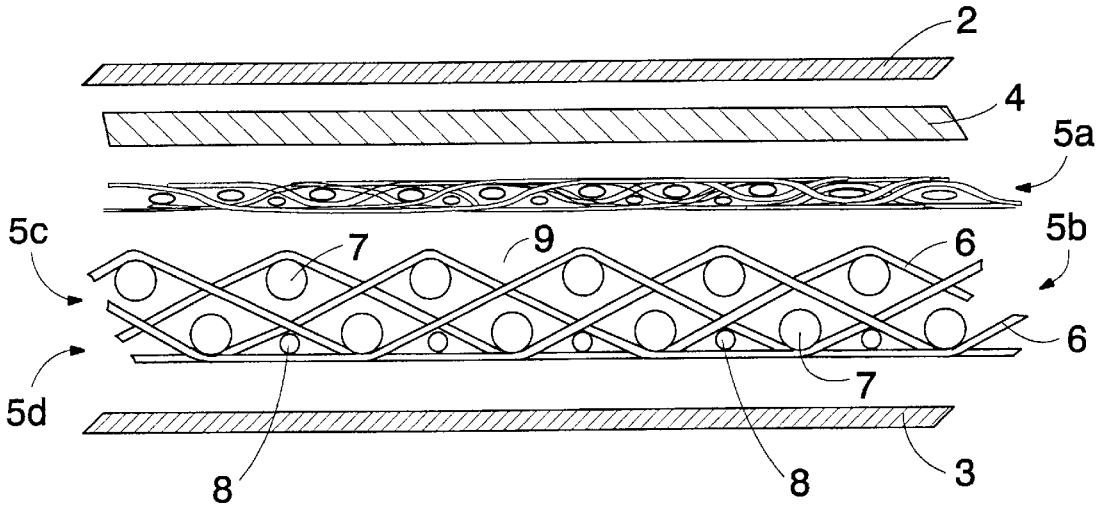

The invention will be described in greater detail in the accompanying drawings, in which FIG. 1 is a schematic side view of a band dryer unit wherein an arrangement according to the invention can be applied, FIG. 2 is a schematic sectional view of an arrangement according to the invention applied in connection with a band dryer and viewed transversely with respect to the direction of travel of the web, and FIGS. 3*a* to 3*i* are schematic cross-sectional views of fine wires according to the invention.

FIG. 1 shows, in a simplified manner, a band dryer known per se, in connection of which the arrangement according to the invention is to be used. The structure and operating principle of the band dryer 1 are already described above in the description of the background art, which will now be referred to. A fibre web 4 to be dried is supplied between a heated upper band 2 and a cooled lower band 3 in a direction of travel A denoted in the figure, together with wires 5*a* and 5*b* supporting the web which are passed together through the dryer. The wires may consist of a woven paper machine fabric with one or more layers, and they are usually bands in the shape of an endless loop, made to travel around different rolls or the like, and they are controlled by the rolls. In the case shown in the figure, there are two wires between the web and the cold band, but at least in principle it is possible to use even a greater number of separate wires. The fabric placed against the web 4 to be dried, shown uppermost in the figure, is a fine wire 5*a* and the lower fabric is a coarse wire 5*b* which may comprise a section with a coarse texture 5*c* placed against the fine wire 5*a* and a section with a fine texture 5*d* placed against the cooled band 3. Such a structure of the coarse wire 5*b* is advantageous for the dewatering capacity of the wire. It is generally required that a coarse wire has a sufficient water retention capacity so that it is capable of transporting the liquid that is separated from the fibre web 4 with the band dryer 1 from between the upper and the lower band 2 and 3. The water retention capacity can be adjusted by means of the thickness of the coarse wire and the textural structure.

FIG. 2 shows, in a very simplified manner, a cross-section of an arrangement according to the invention viewed transversely to the direction of travel of the web. The fabric supporting the web consists of a fine wire 5*a* placed against the web 4 and a separate coarse wire 5*b*. It should be mentioned that the different textural sections are shown separately from one another for the sake of clarity. In actual use, the web to be dried between the metal bands is naturally pressed tightly together with the wires. In the arrangement shown in the figure, the coarse wire 5*b* comprises a coarse-textured section 5*c* facing the fine wire 5*a*, and steam that evaporates from the web is able to pass easily via the larger and more numerous openings thereof through the coarse structure of the wire. The transfer of humidity is thus effective. The coarse-textured section 5*c* of the coarse wire 5*b* facing the web does not cause significant marking in the web 4 through the fine wire 5*a*, if a slightly thicker fine wire is used than previously and/or if the structure of the fine wire is made more rigid so that it does not press into depressions 9 provided on the surface of the coarse side of the coarse wire. Therefore the surface of the coarse wire facing the fine wire does not necessarily have to have a fine texture or to be otherwise especially smooth and even. The openings in the fine-textured section of the coarse wire are placed against the substantially even metal band, so that condensing humidity can be retained on the surface of the coarse wire against the metal band by means of capillary forces, wherefore the web will not get wet again. For the sake of illustration, the figure shows a possible textural structure of the coarse wire comprising warp threads 6 in the machine direction, transverse weft threads 7 and filling threads 8. The fine-textured sections can be formed in the fine wire and the coarse wire for example by using thinner threads than in the coarser section of the wire, and a binding structure providing a closer texture. It is clear that textural structures formed of other kinds of threads and bindings between them are also possible.

In connection with the coarse wire described above which comprises a coarse texture against the fine wire, it is preferable to use a fine wire shown below in FIGS. 3*a* to 3*i*, comprising at least three and preferably exactly three interwoven layers: a surface 10 facing the web, a bottom 11 facing the coarse wire and a middle section 12 situated between them. The density of the surface and the bottom is greater than that of the middle section. The close structure provided by means of the threads on the surface 10 of the fine wire reduces marking, since a dense structure has more contact points between which the contact pressure can be distributed. In such a case the contact area is greater. The dense surface simultaneously prevents rewetting and improves heat transfer capacity. Further, the surface is preferably made such that the warp threads 6 in the machine direction are partly sheltered by the rest of the structure so that they are not worn so easily on the side of the paper, wherefore the risk of a wire break occurring in the prior art fine wires can be prevented. In such a structure, the compression acting on the wire is advantageously directed more towards the transverse threads than the threads in the machine direction. This feature will be described below in connection with FIGS. 3*a* to 3*i*. Further, the middle section 12, which is provided with a looser texture than the surface and the bottom, improves the transverse stability and bending stiffness of the fine wire. The middle section thus increases the strength of the wire. Further, by means of the middle section it is possible to easily make the wire slightly thicker than normally, if required. The wire thickness is normally in the range of 0.6 to 0.7 mm, but by making the loose middle section thicker the wire thickness can be easily increased to about one millimetre and even more. However, when designing the thickness of the middle section it should be taken into account that the wire does not transport too much air between the metal bands and cause an air blow, and further, that the wire can be dried sufficiently after the washing before it is passed again between the metal bands. On the other hand, if the fabric can be made sufficiently stiff, the middle section and thus also the entire fine wire may be rather thin. The bottom 11 of the fine wire is made dense, even and suitably stiff so that the wire cannot press into the uneven spots in the coarse texture of the coarse wire. The middle section providing strength also prevents the aforementioned pressing of the fine wire and thus the marking. Furthermore, the smooth bottom prevents the wearing of the contact surfaces of the coarse wire and the fine wire. Material for the threads of the wire can be any suitable plastic material that withstands hydrolysis, for example polyethylene terephthalate (PET), polyamide (PA), polyphenylene sulphide (PPS), polyetheretherketone (PEEK), polydimethylene cyclohexylene terephthalate (PCTA) or polyethylene naphthalate (PEN).

Figure 3A:
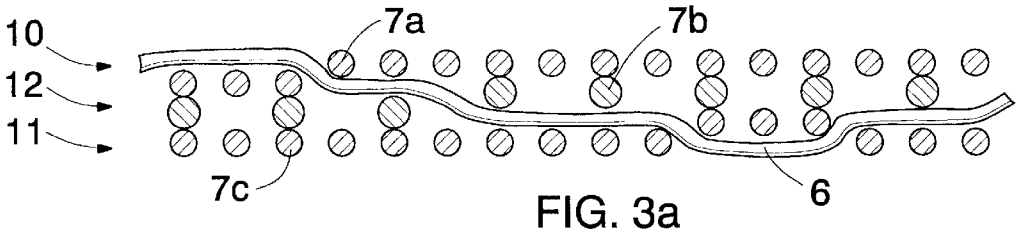
Figure 3C:
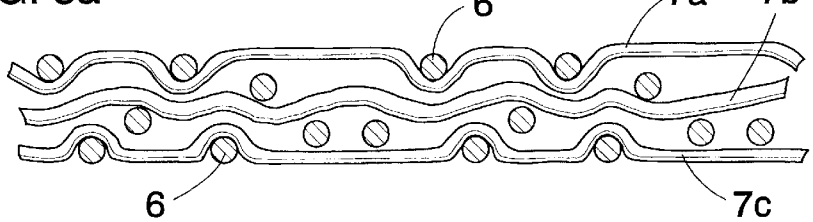
Figure 3B:
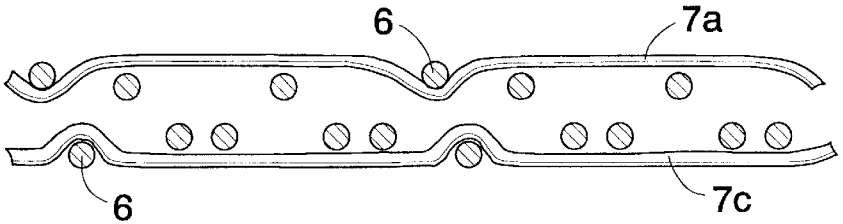
Figure 3D:
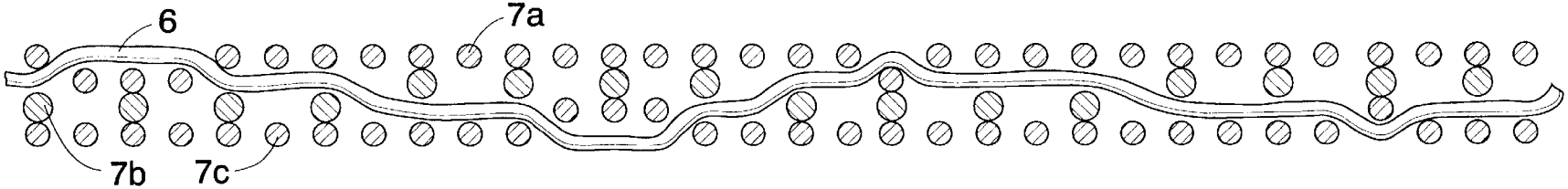
Figure 3F:
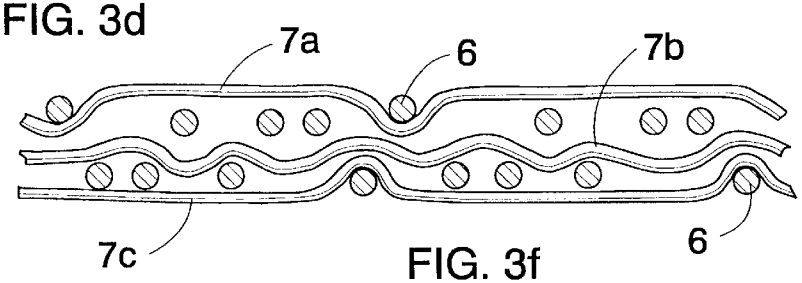
Figure 3E:
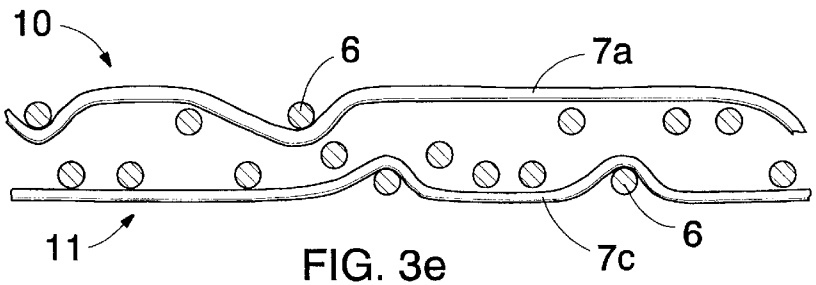
Figure 3G:
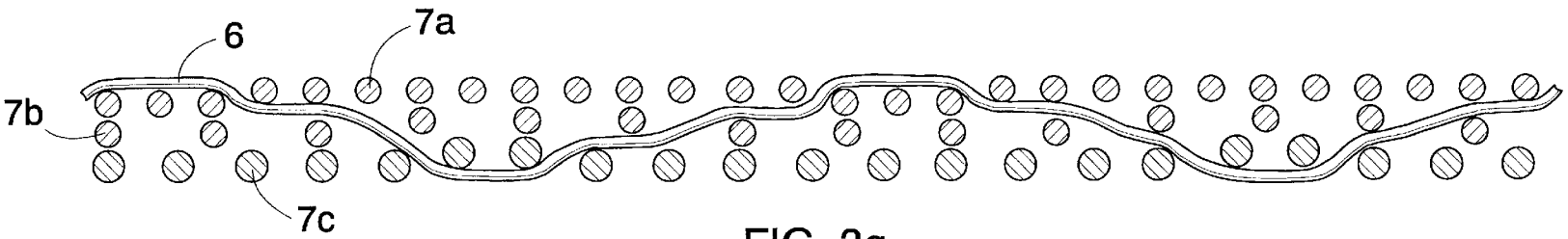
Figure 3I:
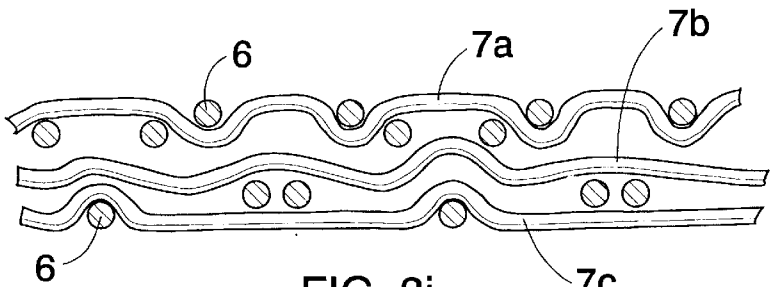
Figure 3H:
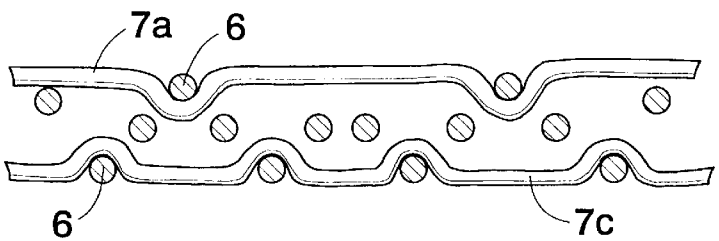

FIGS. 3*a*, 3*d* and 3*g* are simplified cross-sectional views of possible structures of a fine wire viewed transversely with respect to the direction of travel of the web. FIGS. 3*b* and 3*c*, 3*e* and 3*f*, and 3*h* and 3*i* further show these wire structures in a cross-section viewed from the direction of travel of the web, shown from different points of the structure. The textures shown in FIGS. 3*a*–3*c*, 3*d*–3*f* and 3*g*–3*i* thus correspond to each other, but they are shown from different directions. The fine wires 5*a* shown in the figures comprise three interwoven layers, and the texture of the outermost layers 10, 11 is denser than the texture of the middle section 12. Unlike the structure shown in FIGS. 3*a* to 3*f* which is symmetrical with respect to density, FIGS. 3*g* to 3*i* show a fine wire where the surface 10 has a denser texture than the bottom 11. Further, it can be mentioned that the warp thread 6 in the machine direction of the structures shown in FIGS. 3*a* and 3*d* has preferably a thickness of 0.17 mm, the upper weft thread 7*a* has a thickness of 0.17 mm, the middle weft thread 7*b* 0.19 mm and the lower weft thread 7*c* again 0.17 mm. The threads of the structure shown in FIG. 3*g* are equal in thickness except for the lower weft thread. In this figure, the lower weft thread 7*c* is preferably slightly thicker, for example 0.20 mm. Further, the bottom layer 11 is provided with a looser texture and therefore it is less dense than the surface layer 10. It can also be seen from the figures that the warp thread 6 presses into the structure so that its outer surface is approximately at the same level as the plane formed by the weft threads 7*a*, 7*c* on the wire surface, or it presses even further inwards, in which case the weft threads are mainly subjected to the wearing effect.

It is further mentioned that the behaviour of the wires in the drying section and their dewatering properties can be controlled by adjusting the hydrophobicity and/or hydrophilicity of the different wire layers in a desired manner. A wire may be either entirely hydrophobic or correspondingly entirely hydrophilic. Further, a wire can be provided with hydrophobic and/or hydrophilic sections for example only in desired predetermined layers thereof. Increasing the hydrophobicity or hydrophilicity of a wire or a certain layer thereof makes it easier to clean the wire and to keep it clean and also improves the dewatering properties of the wire. Dirt-repellent compounds forming a film usually greatly reduce the surface energy and are hydrophobic, but they may also be hydrophilic. A hydrophobic part usually consists of a hydrocarbon chain (CH 2)n or an aromatic cyclic compound. Hydrophobic compounds also include silicone-based or fluorine-based polymers and mixtures thereof. Further, polyester thread, which is greatly used as a material for wires, is rather hydrophobic as such and does not therefore absorb water. Hydrophobic polymers also often have low surface energy, which increases their ability to repel dirt and facilitates the cleaning of wires. An example of such a fluorine compound is polytetrafluoroethylene (PTFE), which is known by the trade name Teflon®. The surface energy of PTFE is only 18 $mJ/m^2$. There are several manners of providing a wire with a hydrophobic structure. Hydrophobicity can be achieved, for example, by treating the finished wire or a certain layer thereof through spraying or soaking, for instance, or by using hydrophobic threads in desired parts of the wire structure, thus making a certain layer of the wire hydrophobic. A hydrophobic thread can be produced by making the thread from a hydrophobic material, such as PTFE, by coating a thread made of a material used in the manufacture of wires with a hydrophobic cover, or by mixing a hydrophobic polymer with a thread material commonly used for wires. The threads can naturally also be treated, for example, by spraying or soaking with a hydrophobic polymer or a polymer mixture. Correspondingly, examples of hydrophilic groups in an aqueous solution include —COOH, —OH, —NH2, —O—, —CONH—, —COO—, —SO3, —OSO3 and —N+(CH3)3. It can be mentioned as an example that a polyamide thread used widely in paper machine fabrics is rather hygroscopic as such, since it is able to absorb quite a high percentage of water. Due to its character, polyamide has also hydrophilic properties. Furthermore, the hydrophilicity of a polyester thread can be increased similarly as its hydrophobicity. On the other hand, mixing a hydrophilic component with a polyester polymer is not considered a very good solution since the absorption of water into the inner structures of the thread thus becomes easier, wherefore the risk of hydrolysis increases. The most advantageous manner of increasing hydrophilicity of a thread is probably surface treatment with a hydrophilic component. Adding hydrophilic groups to the surface of a polyester can also be implemented by grafting, wherein the hydrophilic groups are made to adhere to the surface of the polyester through irradiation, for example.

The drawings and the related description are only intended to illustrate the inventive idea. The details of the invention may vary within the scope of the claims. Therefore, a fine wire may comprise more textural layers than disclosed above. Further, the properties disclosed above in the specification can also be provided in the wire by means of structures other than those made by weaving. It should also be mentioned that it is obvious for a person skilled in the art to apply, for example, different bindings, thread materials and threads with different cross-sections to manufacture wires of the arrangement according to the invention. It should also be mentioned that several band dryer units described above may be placed in succession, and that the successive units may be placed alternately in different positions with respect to the web. Yet, the present invention can be applied therein.

What is claimed is:

1. An arrangement for a drying section of a paper machine, the arrangement comprising a fine wire and a coarse wire which are formed of several threads and withstand high temperatures and humidity, the wires being arranged to pass through the drying section between a heated and a cooled metal band provided in the drying section, together with a fibre web placed against the heated band, such that the fine wire is arranged against the web to be dried and the coarse wire is arranged against the cooled metal band, wherein the fine wire comprises at least three interwoven layers, wherein surface layers arranged against the web and the coarse wire are denser than a middle section situated between them.

2. An arrangement according to claim 1, wherein the bottom of the fine wire is not as dense as the surface of the wire facing the paper web.

3. An arrangement according to claim 1, wherein, regarding density, the structure of the fine wire is substantially symmetrical with respect to the central axis thereof.

4. An arrangement according to claim 1, wherein the texture of the bottom of the fine wire is loose to such an extent that water condensed in the coarse wire is not able to pass from the coarse wire to the fine wire due to capillary forces.

5. An arrangement according to claim 1, wherein the side of the coarse wire arranged against the cooled metal band has a fine texture, and against said fine-textured section there is a coarse-textured section of the coarse wire.

6. An arrangement according to claim 1, wherein the coarse wire comprises a fine-textured section both on the side of the cooled metal band and on the side of the fine wire, and between these fine-textured sections there is a coarse-textured section.

* * * * *